US009231311B2

(12) United States Patent
Tiezzi et al.

(10) Patent No.: US 9,231,311 B2
(45) **Date of Patent: *Jan. 5, 2016**

(54) METHOD AND APPARATUS FOR A COMPACT MODULAR PHASED ARRAY ELEMENT

(71) Applicant: ViaSat, Inc., Carlsbad, CA (US)

(72) Inventors: Ferdinando Tiezzi, Renens (CH); Stefano Vaccaro, Gland (CH); Daniel Llorens del Rio, Lausanne (CH); Roberto Torres Sanchez, Lausanne (CH)

(73) Assignee: ViaSat, Inc., Carlsbad, CA (US)

( * ) Notice: Subject to any disclaimer, the term of this patent is extended or adjusted under 35 U.S.C. 154(b) by 175 days.

This patent is subject to a terminal disclaimer.

(21) Appl. No.: 13/931,252

(22) Filed: Jun. 28, 2013

(65) Prior Publication Data

US 2014/0253400 A1 Sep. 11, 2014

Related U.S. Application Data

(63) Continuation of application No. 12/847,897, filed on Jul. 30, 2010, now Pat. No. 8,482,475.

(60) Provisional application No. 61/230,491, filed on Jul. 31, 2009, provisional application No. 61/241,284, filed on Sep. 10, 2009.

(51) Int. Cl.

| | |
|---|---|
| ***H01Q 13/08*** | (2006.01) |
| ***H01Q 21/28*** | (2006.01) |
| ***H01Q 21/00*** | (2006.01) |

(Continued)

(52) U.S. Cl.
CPC ..... *H01Q 21/0075* (2013.01); *H01Q 3/26* (2013.01); *H01Q 9/0457* (2013.01); *H01Q 13/10* (2013.01); *H01Q 21/065* (2013.01); *Y10T 29/49016* (2015.01)

(58) Field of Classification Search
CPC ..... H01Q 13/10; H01Q 21/0075
USPC ..... 343/770, 824, 829, 846, 830, 700 MS
See application file for complete search history.

(56) References Cited

U.S. PATENT DOCUMENTS 5,043,738 A * 8/1991 Shapiro et al. ..... 343/700 MS
5,966,096 A 10/1999 Brachat (Continued)

OTHER PUBLICATIONS

Ferrero, "Polarisation-Reconfigurable Patch Antenna", 2007, IEEE 1-4244-1088-6/07, pp. 73-76.*

(Continued)

*Primary Examiner* — Daniel D Chang
(74) *Attorney, Agent, or Firm* — Snell & Wilmer L.L.P.

(57) ABSTRACT

In various embodiments, a radiating cell of an antenna array can comprise a compacted hybrid as part of a stripline feed network, a radiating element having slots rotated with respect to the compacted hybrid, and a feed circuit layer in communication with the stripline feed network. The radiating cell radius can be a ½ wavelength or less. Furthermore, the compacted hybrid has two input ports and two output ports, where the input and output ports of the compacted hybrid are non-orthogonal and non-parallel to the slots of the radiating element. A radiating cell can comprise a ground plane with a first side and a second side, where the ground plane comprises a slot. The slot can be non-orthogonal and non-parallel to the two output ports of the feed network.

15 Claims, 12 Drawing Sheets

(51) Int. Cl.

| | |
|---|---|
| ***H01Q 3/26*** | (2006.01) |
| ***H01Q 9/04*** | (2006.01) |
| ***H01Q 21/06*** | (2006.01) |
| ***H01Q 13/10*** | (2006.01) |

(56) References Cited

U.S. PATENT DOCUMENTS

| | | | |
|---|---|---|---|
| 6,114,997 | A | 9/2000 | Lee et al. |
| 6,388,620 | B1 | 5/2002 | Bhattacharyya |
| 2003/0043074 | A1* | 3/2003 | Bhattacharyya et al. ..... 343/700 MS |
| 2004/0239565 | A1 | 12/2004 | Brachat |
| 2007/0146206 | A1 | 6/2007 | Sun |
| 2008/0238973 | A1 | 10/2008 | Yamanobe |

OTHER PUBLICATIONS

F. Ferrero, et al., "A Reconfigurable Hybrid Coupler Circuit for Agile Polarisation Antenna," Antennas and Propogation, EuCap 2006, First European Conference on . . . , Nov. 6-10, 2006 (ESA SP-626, Oct. 2006), pp. 1-5, Nice, France.

F. Ferrero, et al., "Polarisation-Reconfigurable Patch Antenna," Antenna Technology: Small and Smart Antennas Metamaterials and Applications, 2007, pp. 73-76.

Notice of Allowance dated Mar. 7, 2013 in U.S. Appl. No. 12/847,897.

Office Action dated Sep. 25, 2012 in U.S. Appl. No. 12/847,897.

Tripathi, V.K., et al. "Analysis and Design of Branch-Line Hybrids with Coupled Lines," IEEE Trans. Microwave Theory Tech., vol. 32, No. 4, pp. 427-432, Apr. 1984.

Liao, S., et al. "A Novel Compact-Size Branch-Line Coupler," IEEE Microwave and Wireless Components Letters, vol. 15, No. 9, pp. 588-590, Sep. 2005.

Sun, K., et al. "A Compact Branch-Line Coupler Using Discontinuous Microstrip Lines," IEEE Microwave and Wireless Component Letters, vol. 15, No. 8, pp. 519-520, Aug. 2005.

International Search Report and Written Opinion from corresponding Int'l Application No. PCT/US2010/044047 dated Feb. 28, 2011.

International Preliminary Report on Patentability from corresponding Int'l Application No. PCT/US2010/044047 dated Feb. 9, 2012.

EPO; Search Report mailed Jul. 18, 2014 in corresponding European Application No. 10805156.6.

* cited by examiner

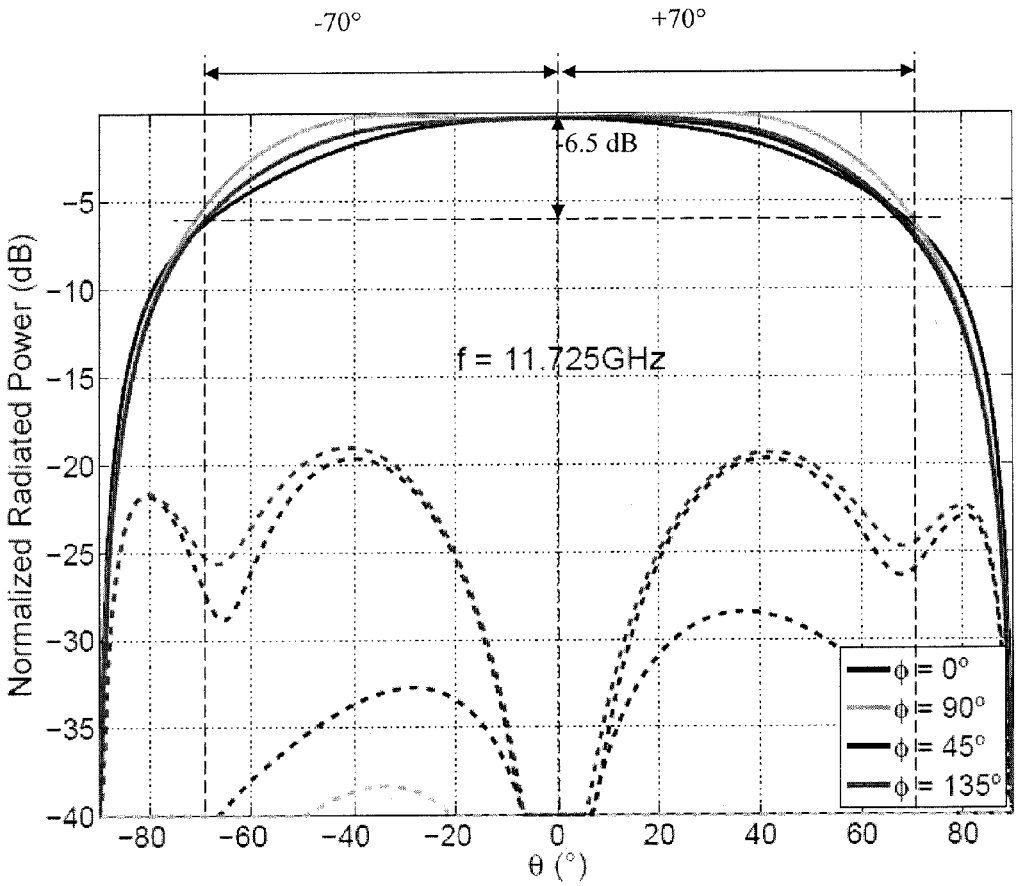
Figure 6: Example of broad radiation pattern symmetrical in Azimuth.

METHOD AND APPARATUS FOR A COMPACT MODULAR PHASED ARRAY ELEMENT

CROSS-REFERENCE TO RELATED APPLICATIONS

This application is a continuation of and claims priority to and benefit of U.S. application Ser. No. 12/847,897, filed Jul. 30, 2010, and entitled "METHOD AND APPARATUS FOR A COMPACT MODULAR PHASED ARRAY ELEMENT," issued as U.S. Pat. No. 8,482,475 on Jul. 9, 2013. The '475 patent which claims priority to U.S. Provisional Application No. 61/230,491, filed on Jul. 31, 2009, and entitled "MODULAR PHASED ARRAY APPROACH", and further claims priority to and benefit of U.S. Provisional Application No. 61/241,284, filed on Sep. 10, 2009, and entitled "MODULAR PHASED ARRAY APPROACH", all of which are hereby incorporated by reference.

FIELD OF INVENTION

The present invention relates to the structure of a compact radiating element structure to be implemented in a fully electronic steerable beam antenna.

BACKGROUND OF THE INVENTION

Many existing and future mobile vehicular applications require high data rate broadcasting systems ensuring full continental coverage. With respect to terrestrial networks, satellite broadcasting facilitates having such continuous and trans-national coverage of a continent, including rural areas. Among existing satellite systems, Ku-band and Ka-Band capacity is widely available in Europe, North America and most of the other regions in the world and can easily handle, at a low cost, fast and high-capacity communications services for commercial, military and entertainment applications.

The application of Ku/Ka-band to mobile terminals typically requires the use of automatic tracking antennas that are able to steer the beam in azimuth, elevation and polarization to follow the satellite position while the vehicle is in motion. Moreover, the antenna should be "low-profile", small and lightweight, thereby fulfilling the stringent aerodynamic and mass constraints encountered in the typical mounting of antennas in airborne and automotive environments.

Typical approaches for beam steering are: full mechanical scan or hybrid mechanical electronic scan. The main disadvantages of the first approach for mobile terminals is the bulkiness of the structure (size and weight of mechanical parts), the reduced reliability (mechanical moving parts are more subject to wear and tear than electronic components) and high assembling costs (less suitable for mass production). The main drawback of hybrid electronic steering is that the antenna still requires mechanical pointing; partially maintaining the drawbacks of mechanical scan antennas.

An advantageous approach is to use a full electronic steerable beam antenna, where, in azimuth and in elevation, the scan is performed electronically. This approach doesn't require mechanical rotation. These characteristics facilitate a reduction in the size and the "height" of the antenna that is important in airborne and automotive applications, and facilitate a better reliability factor than a mechanical approach due to the lack of mechanical parts.

In fully electronic phased arrays, the integration of the electronic components within the antenna aperture represents a big challenge due to the high number of components required. Often, this aspect drives the antenna design (element spacing, array lattice, element rotation) leading to a decrease of the antenna performance. The ideal configuration would consist in a radiating element integrating all the electronics in a surface area not larger than a patch antenna of the radiating element. In this way, the complete array would be designed around the radiating element only and optimized for its radiating performance.

SUMMARY OF THE INVENTION

In various embodiments, a radiating cell of an antenna array can comprise a compacted hybrid as part of a stripline feed network, a radiating element having slots rotated with respect to the compacted hybrid, and a feed circuit layer in communication with the stripline feed network. The radiating cell radius can be a ½ wavelength or less. Furthermore, the compacted hybrid has two input ports and two output ports, where the input and output ports of the compacted hybrid are non-orthogonal and non-parallel to the slots of the radiating element.

In accordance with other various embodiments, a modular phased array can comprise a ground plane with a first side and a second side, where the ground plane comprises a slot; a patch antenna located on the first side of the ground plane, a feed network located on the second side of the ground plane, wherein the first side is opposite the second side. The feed network can comprise a compacted hybrid with two output ports. Furthermore, the ground plane can isolate the patch antenna from the feed network. The distance from the center of the patch antenna to the farthest output port of the two output ports of the compacted hybrid can be a ½ wavelength or less. In addition, a method of isolating radiation of a radiating element can comprise communicating a signal through a patch antenna, and positioning a ground plane between the patch antenna and a feed network. The feed network can comprise two input ports and two output ports, the include positioning the farthest output port of the two output ports within a distance of ½ wavelengths or less from the center of the patch antenna.

BRIEF DESCRIPTION OF THE DRAWINGS

Advantages of the invention and the specific embodiments will be understood by those of ordinary skill in the art by reference to the following detailed description of preferred embodiments taken in conjunction with the drawings, in which:

FIG. 6 illustrates a graphical representation of a radiation pattern of an exemplary radiating element structure;

DETAILED DESCRIPTION OF THE PRESENT INVENTION

While exemplary embodiments are described herein in sufficient detail to enable those skilled in the art to practice the invention, it should be understood that other embodiments may be realized and that logical electrical and mechanical changes may be made without departing from the spirit and scope of the invention. Thus, the following detailed description is presented for purposes of illustration only.

Figure 1:
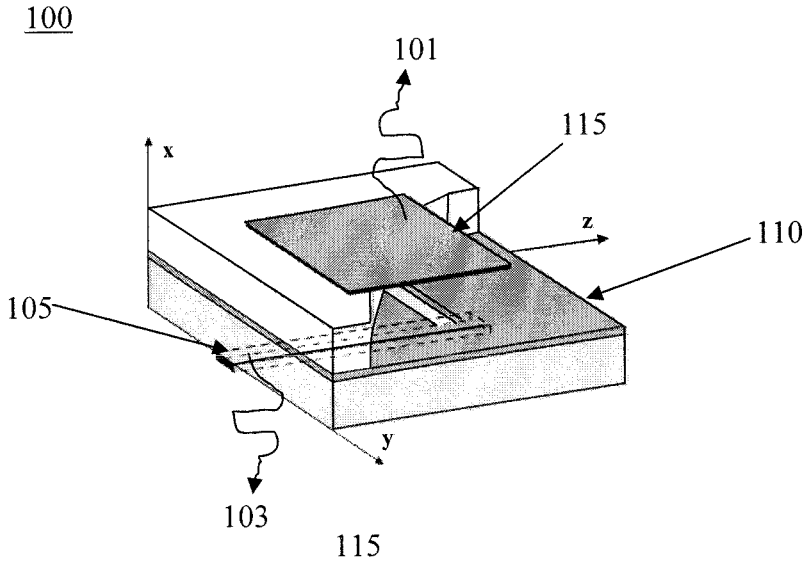
FIG. 1 illustrates an exemplary embodiment of a microstrip antenna feed.

In accordance with an exemplary embodiment, and with reference to FIG. 1, a radiating element structure 100 comprises a ground plane 110 located below a patch antenna 115 and above a feed line 105. From this arrangement, radiation 101 from patch antenna 115 radiates away from ground plane 110 and radiation 103 from feed line 105 radiates in the opposite direction. Ground plane 110, sometimes referred to as an aperture coupling mechanism, allows the separation of radiating element structure 100 into two separate layers: a radiating circuit layer and a feed circuit layer. In an exemplary embodiment, ground plane 110 is made of metal. Furthermore, ground plane 110 may be made of any suitable material that prevents the transmission of spurious radiation as would be known in the art. The circuitry may be any circuits used for transmit or receive antennas. For example, see U.S. patent application Ser. No. 12/274,994, entitled "Antenna Modular Sub-array Super Component", which was filed on May 9, 2008 and is incorporated herein by reference.

Figures 2A, 2B:
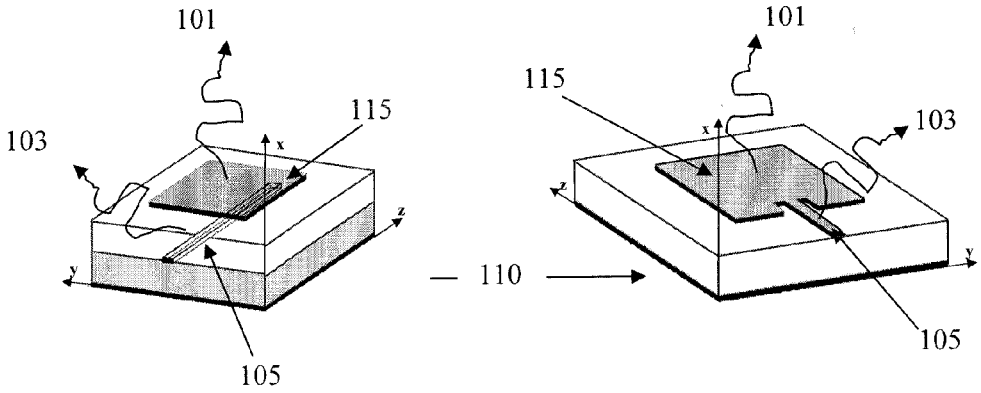
FIGS. 2A and 2B illustrate prior art embodiments of microstrip antenna feeds.

In an exemplary embodiment, this separation of layers prevents, or substantially prevents, the spurious radiation from the feed circuit layer from affecting the overall pattern of the antenna. The radiation from patch antenna 115 does not pass through ground plane 110, thereby substantially isolating patch antenna 115 and feed line 105 from each other. This isolation improves the signals by decreasing mutual-inference from circuitry radiation 103 and patch antenna radiation 101. In contrast, as depicted in FIG. 2A and FIG. 2B, if a feed line 105 is on the same side of a ground plane 110 as a patch antenna 115 with respect to ground plane 110, then feed line 105 radiation interferes with radiation from patch antenna 115. This can have a very negative effect by affecting the purity of polarization.

In an exemplary embodiment, an antenna assembly includes at least one radiating element, at least one dielectric layer, a ground plane with a slot, and a microstrip line. The ground plane is located between the microstrip line and the radiating element(s). In one embodiment, the radiating element is a patch antenna. In another embodiment, the radiating element is at least one of a dipole, a ring, and any other suitable radiating element as would be known to one skilled in the art.

In an exemplary embodiment, radiating element structure 100 further comprises a dielectric layer that separates other antenna assembly components from one another. The dielectric may be air or any material that separates patch antenna 115 from ground plane 110 and allows signals to pass through the dielectric layer. In an exemplary embodiment, the dielectric material is a foam material. For example, the foam material may be Rohacell HF with a gradient of 51 or 71. Moreover, dielectric material may be any suitable material as would be known in the art.

In an exemplary embodiment, a ground plane with slots is configured to communicate signals through the slots only, thereby substantially separating the feed circuit layer from the radiating circuit layer. The substantially complete separation of the feed circuit layer from the radiating circuit layer facilitates separately optimizing the materials and independently designing the two layers of the antenna. Typically, requirements for microwave circuits and antennas are very different: microwave circuits often use "high permittivity" dielectric substrates to reduce the size of the circuit, reduce the lines' spurious radiated power and reduce the coupling between the lines. Furthermore, patch antennas are typically based on "low-permittivity" dielectric substrates that facilitate higher radiation efficiency, lower losses and larger bandwidth.

The two ideals for microwave circuits and antennas are clearly in contrast if the radiators and the feed lines are on the same side of the ground plane and share the same dielectric material. In an exemplary embodiment, the separation of feed circuit and radiators by a ground plane simplifies the design since the feed circuit layer on a first side and the radiating circuit layer on an opposite second side may be independently adjusted, and designed without heavily considering the possible interactions (couplings) between feed circuits and radiators. In an exemplary embodiment, the slot, the patch antenna, and the feed network can be optimized independently since all three are separated and on different layers. An exemplary radiating element structure facilitates locating lines and/or components very close to the slots without affecting the radiation characteristics. In typical prior art configurations with feed circuit and radiators on the same side of the ground plane, it is preferable to leave as much empty surface as possible under the patches to avoid unwanted coupling between feeding circuits and patches. This unused area represents a large portion of the antenna, reducing the space available for feed line routing. In accordance with an exemplary embodiment, with a ground plane separating the patch antenna and the feed circuit layer, feed lines are routed throughout the area underneath the patch antenna while avoiding the area near the slots.

Figure 3:
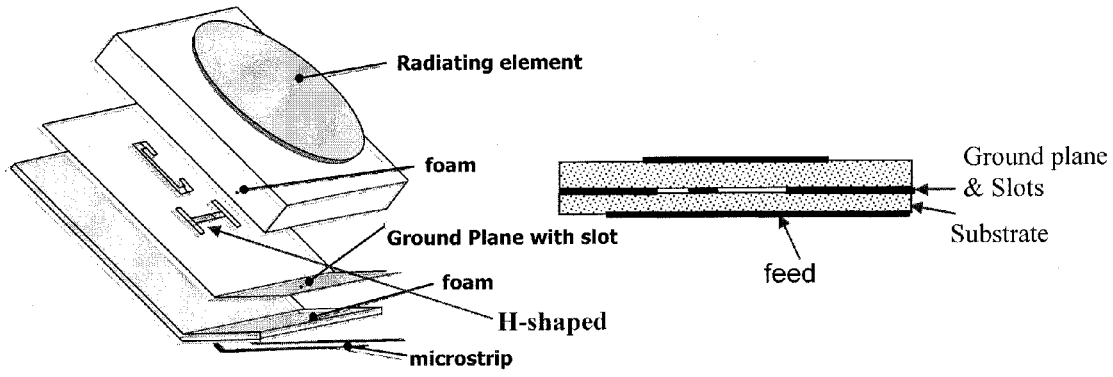
FIG. 3 illustrates perspective and side views of an exemplary radiating element structure with slots in a ground plane.

In accordance with an exemplary embodiment, a slot is used to couple excitation signals from the feed lines to the patch antenna. In an exemplary embodiment, and with reference to FIG. 3, the ground plane may include two slots substantially orthogonal to each other. In another embodiment, the ground plane may include an "H"-shaped slot and/or a "C"-shaped slot, where one slot is horizontally orientated and the other is vertically orientated. Furthermore, in yet another embodiment, the slots may be orientated at any angle while still substantially orthogonal to each other. This embodiment provides good isolation between the two slots allowing better purity of the polarized signals.

Furthermore, in an exemplary embodiment, the size of the slots is optimized in order to obtain the best impedance matching between the patch antenna and the feed circuit without changing the size of the patch. In one exemplary embodiment, optimization is accomplished using computer simulations. For example, in one exemplary embodiment, the length of the slot is smaller than ½ wavelength. Once the best impedance matching is achieved, the patch size can be modified to center the frequency band as desired without affecting the matching. Therefore, the presence of the slots gives additional degrees of freedom when trying to satisfy simultaneous requirements of impedance matching and frequency characteristics, such as tuning and bandwidth.

The benefits of using a compact slot, such as an "H"-shaped slot, include a more compact size compared to a linear slot and offering a smaller required surface for coupling with the patches. Stated another way, more patches can be fit in the same space with a compact "H"-shaped slot, or any similar compact slot, than with a linear slot. In addition, a compact slot design with optimized size increases the polarization purity as described above, and ensures a low coupling between two orthogonal polarizations.

In an exemplary embodiment, a slot feed excites a very pure resonant mode on a patch antenna with a very low cross polarization component. This excitation method provides much better polarization results than other feed models, such as, for example, line feed, coaxial-pin feed, and electromagnetic coupling feed models. In an exemplary embodiment, the cross polarization level is below −15 dB. In another embodiment, the cross polarization level is below −20 dB. In yet another exemplary embodiment, the cross polarization level is below −25 dB. As previously described, in an exemplary embodiment, a ground plane is located between microstrip lines and the radiating element such that spurious radiation generated by the microstrip lines does not contribute to the total radiation pattern. The separation of feed line circuits from radiating elements avoids spurious radiation from circuits, and thus avoids causing the cross-polarization level to rise.

An exemplary array antenna comprises radiating elements based on the use of stacked patch resonators. The designed "stacked resonator" structure provides enhanced design flexibility and facilitates various improvements. In accordance with an exemplary embodiment and with reference to FIG. 4, a stacked resonator structure 400 comprises a feed line 405, a ground plane 410, a first radiating element 415, a second radiating element 416, and dielectric material 420 located between the layers. In one embodiment, stacked resonator structure 400 has first radiating element 415 positioned nearest to ground plane 410 and second radiating element 416 positioned farthest from ground plane 410. First radiating element 415 positioned nearest to ground plane 410 is coupled to second radiating element 416 positioned farthest away from ground plane 410. In an exemplary embodiment, second radiating element 416 may be configured to improve the front-to-back ratio of radiation. In an exemplary embodiment, first radiating element 415 may be configured to improve the bandwidth. Furthermore, in an exemplary embodiment, the stacked resonator structure comprises multiple radiating elements that may be stacked to facilitate placing at least one radiating element a substantial distance from the ground plane further than otherwise could be done without stacking the components.

In an exemplary embodiment, the two patches on the stack are positioned at a given spacing and have a small difference in size that allows increasing the bandwidth of the radiating element. Adjusting the size of the two patches relative to one another is another design factor as would be known to one skilled in the art. In addition, other factors may be adjusted as would be known to one skilled in the art. In an exemplary embodiment, each patch is optimized to resonate on a specific frequency band, and the combination of the different bands results in a larger bandwidth. This is an important characteristic where more than 20% of bandwidth is required in a design. The stacked configuration provides more bandwidth than necessary and hence gives more flexibility in the design to meet other design requirements. In accordance with an exemplary embodiment, the combination of the slot in a quasi resonant mode with the resonant patch facilitates an increase in the matched bandwidth of the radiating element. In one exemplary embodiment, the bandwidth is increased from 5% of bandwidth of a simple line-fed patch to more than 20% of bandwidth of a stacked patch configuration. In another embodiment, the bandwidth is increased from 5% to 30% of bandwidth, depending on the specific application.

With respect to an antenna array and spacing between radiating element structures, in phased array antennas, the scan range determines the element spacing. In an exemplary embodiment, for a broad scan range (e.g. >+/−50°) the elements remain within a distance less than 0.6 wavelengths of each other. The design of a radiating element for an array grid smaller than 0.6 wavelengths involves complex design aspects. For example, in such complex designs the directivity of the element needs to be compatible with the element spacing. An approximate rule to determine the directivity (D) from the element spacing is:

$$D \equiv 10 \times \log_{10}\left(\frac{2\Pi \times \text{element spacing}}{\text{wavelength}}\right)$$

Figure 4:
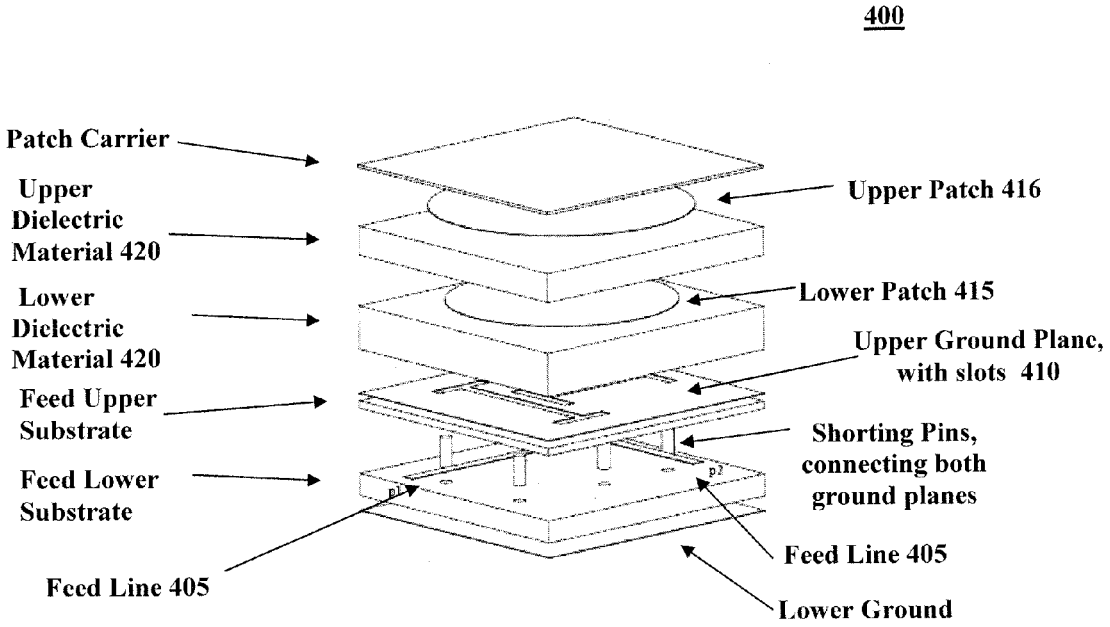
FIG. 4 illustrates an exploded perspective view of an exemplary radiating element structure with multiple patch antennas.

Applying this rule, an array lattice spaced at 0.6 wavelengths would require an element directivity of 5.8 dBi. The achievement of such directivity is rather challenging with single patch elements. In an exemplary embodiment, stacked patches can be used to decrease the directivity of the radiating element. FIG. 4 illustrates an exemplary element structure used to reduce the element directivity. The particular combination of dielectric materials between the patches and the size of the patches allows for adjusting the element directivity to the desired value. For example, increasing the dielectric constant and implementing smaller patch antennas results in less directivity.

Figure 5A:
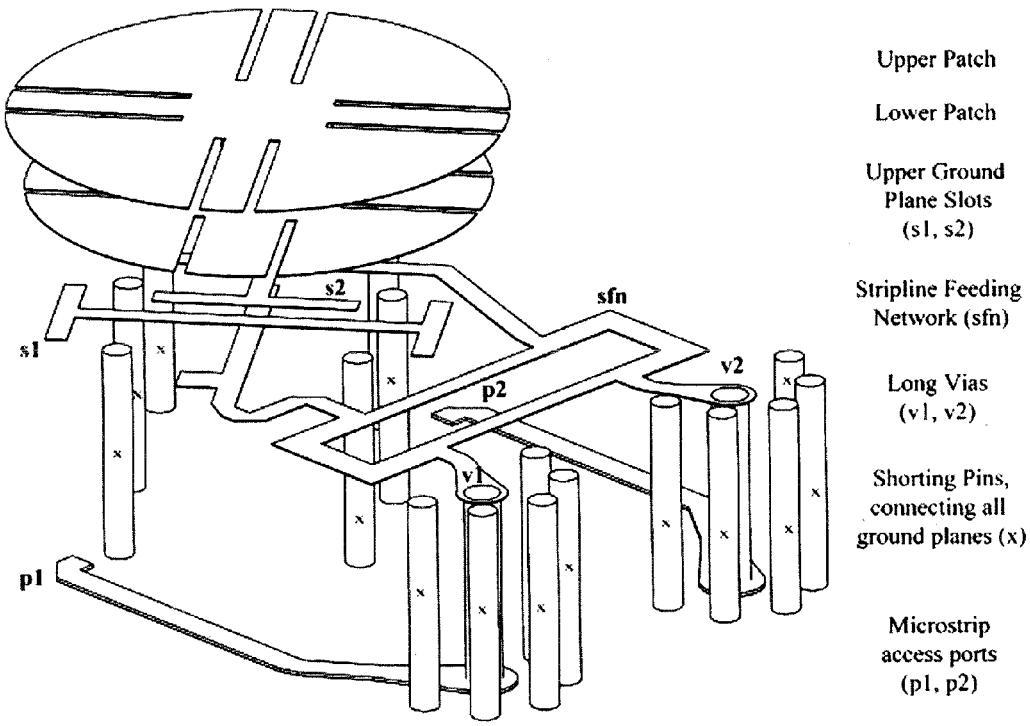
FIGS. 5A and 5B illustrate an exploded perspective view and a top view of an exemplary compact radiating element structure with layers.
Figure 5B:
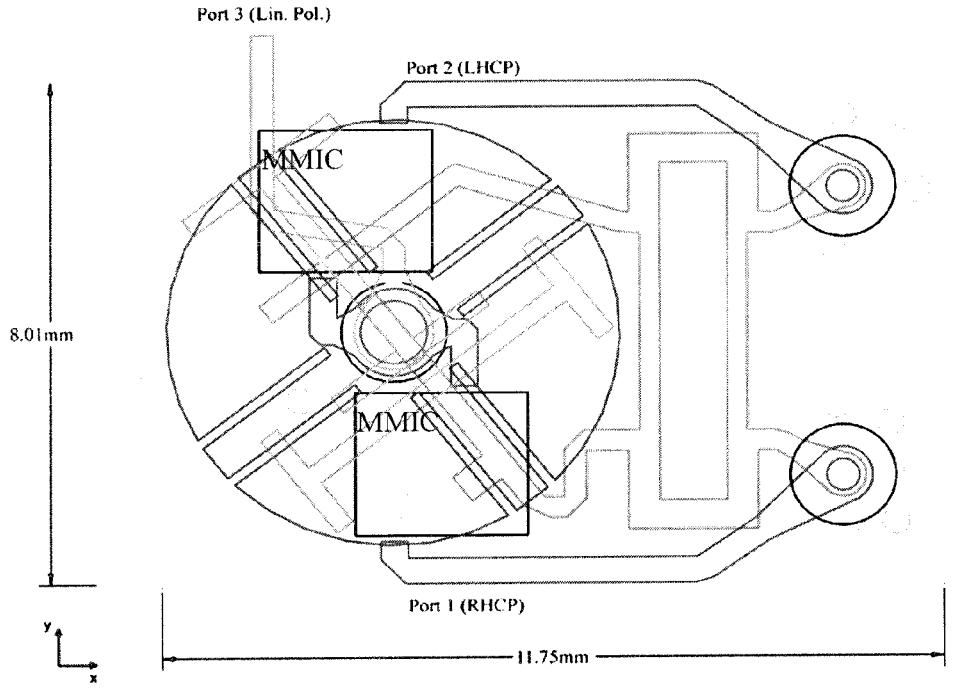

Moreover, in an exemplary embodiment and with reference to FIG. 5, a patch antenna shape can be optimized with a slotted configuration to adjust the element directivity to the desired level. In an exemplary embodiment, the patch antenna slots reduce the size of the patch leading to a reduction in directivity. The selection of the slot arrangement (shape, number of slots, etc) and size can be selected in order to achieve different levels of patch reduction. In an exemplary embodiment, a patch comprises a first single slot in a first quadrant of the patch and a second single slot in a second quadrant of the patch to reduce the patch directivity. In another exemplary embodiment, a patch comprises four single slots in each of the four 90° quadrants of the patch to reduce the patch directivity. In further exemplary embodiments, a combination of multiple slots can be placed in one or more quadrants of a patch in order to reduce the overall directivity of the patch element.

To scan at low elevations in phased array antennas, it is important that the radiating element offers a uniform radiation in azimuth with a usable value of directivity at low elevation. The use of a combination of stacked patches and slotted patches allows obtaining a radiating element with a broad radiation pattern, for example with a roll-off of 6.5 dB from Zenith down to 20° of elevation as depicted in FIG. 6. Moreover, in an exemplary embodiment, the combination of slotted and stacked patches is configured to achieve a radiation pattern with great symmetry in azimuth, as illustrated by curves for different $\phi$ angles on FIG. 6. The precise adjustment of length and the position of each of the slots on the patch may lead to a more symmetrical radiation pattern in azimuth. In an exemplary embodiment, two slots in two opposite quadrants of a patch may be optimized at different lengths in order to compensate an asymmetry generated by the feeding slot or the surrounding elements. In another exemplary embodiment, four slots in four 90° quadrants of a patch can be optimized independently in order to compensate the azimuth asymmetry generated by the feeding slot or the surrounding elements. In yet another exemplary embodiment, multiple slots in different quadrants of a patch may be adjusted in order to achieve a more symmetrical pattern in azimuth.

A phased array antenna is composed of a large number of radiating element structures. In accordance with an exemplary embodiment, each radiating element structure comprises a large number of components. The components may include RF combiners, electronic components, power supplies, interconnections, and the like. An assembly defined by the radiating element structure and all the components can be defined as an "elementary radiating cell" of the phased array. In an exemplary embodiment, the elementary radiating cell is designed using three principles that combined together lead to a unique optimized design.

Elementary radiating cells typically require a large amount of space and can have a strong impact on the antenna layout by limiting the minimum distance to which the elements may be spaced. This results in a limitation of the antenna scan capabilities. FIG. 7A illustrates an example of a radiating element with a prior art non-optimized hybrid combiner. As illustrated in FIG. 7A, a non-optimized hybrid may lead to an elementary radiating cell of a radius of 0.8 wavelengths. In an exemplary embodiment, the radius is measured from the center of the patch antenna to an output port of the hybrid combiner that is the farthest point from the center of the elementary radiating cell. Spacing the radiating elements at this distance affects the scan capabilities of the phased array by reducing the scan range, typically to +/−30°.

Figure 7B:
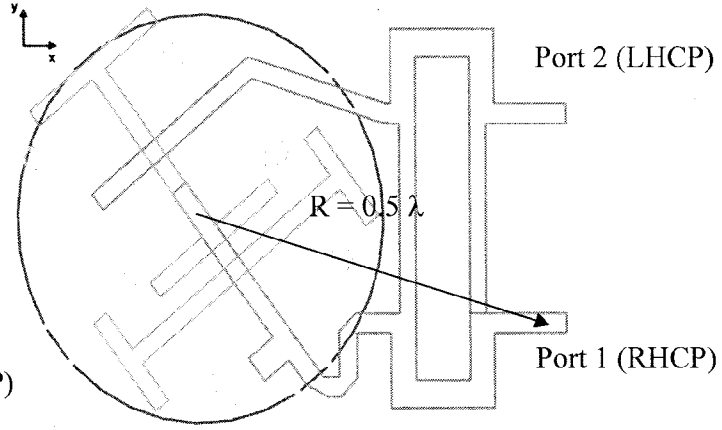
FIG. 7B illustrates an exemplary embodiment of a radiating element with a compact hybrid combiner.
Figure 7A:
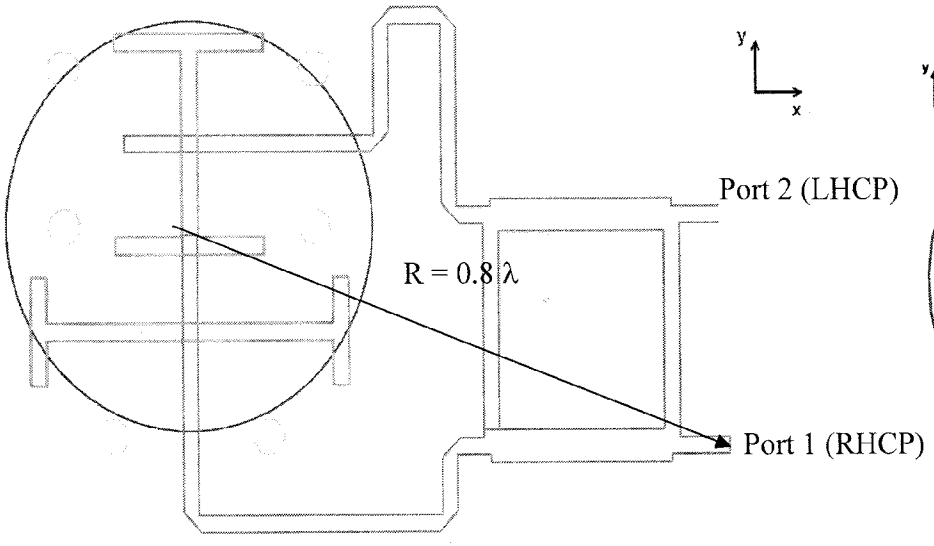
FIG. 7A illustrates a prior art embodiment of a radiating element.

In contrast, FIG. 7B illustrates an exemplary embodiment of an optimized hybrid combiner. In an exemplary embodiment, an elementary radiating cell with an optimized hybrid combiner has a radius at or below 0.5 wavelengths. In an exemplary embodiment, the radius is measured from the center of the patch antenna to an output port of the hybrid combiner that is the farthest point from the center of the elementary radiating cell. In another exemplary embodiment, the radius is measured from the center point of the patch antenna slots to farthest point of the feed circuit layer. This size allows spacing the elements between 0.5 and 0.6 wavelengths which is a spacing compatible with a broad scan range required by phased arrays for mobile SATCOM, typically +/−70°.

Figure 8:
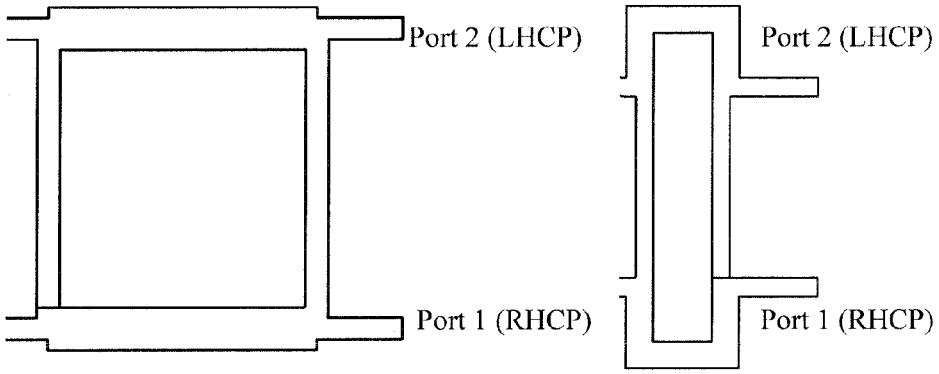
FIG. 8 illustrates a comparison between a prior art hybrid combiner and an exemplary compact hybrid combiner.

In an exemplary embodiment, the combiner is optimized to reduce the length of the cell. FIG. 8 illustrates the difference between a standard hybrid combiner and an exemplary compacted hybrid. The compression of the hybrid is achieved by bending and folding two of the branches and by bring the other two orthogonal branches closer together. The result of this design is that the distance between input ports and output ports of the hybrid are closer to one another.

In addition, in an exemplary embodiment, a dual polarized radiating element is connected to a hybrid combiner using two paths of equal length. As illustrated by FIGS. 7A and 7B, two transmission paths of equal length join the hybrid with the radiating element in both embodiments. The two paths are configured to communicate signals with different polarizations. For example, a first port communicates a right-hand circular polarized signal and a second port communicates a left-hand circular polarized signal. However, in an exemplary embodiment, the two paths are reduced in length by rotating the radiating element with respect to the compact hybrid. In an exemplary embodiment, the reduced path lengths bring the patch feeding points closer to the hybrid inputs while maintaining the equal lengths of each path. This results in an exemplary compact cell having transmission paths connecting the radiating element to the hybrid that are much shorter due to the radiating element being rotated around its center with respect to the hybrid combiner.

In an exemplary embodiment, a compact hybrid combiner comprises two input ports and two output ports. The two input ports and two output ports are part of the two transmission paths. Furthermore, in an exemplary embodiment, the two input ports and two output ports of the compact hybrid are non-orthogonal and non-parallel to the slots of the radiating element. In other words, a center axis of a slot in the ground plane is oriented at an angle to the ports of the compact hybrid. In one embodiment, a center axis of the slot of the ground plane is at a 45° angle to the output ports of the compact hybrid, which is part of the feed network. In another embodiment, a center axis of the slot of the ground plane is at an angle to the output ports of the compact hybrid within the range of 20-70°. Moreover, a center axis of the slot of the ground plane may be at any angle to the output ports of the compact hybrid that is not n*90°, where n is an integer.

In accordance with an exemplary embodiment, electronic components like LNA, phase shifters, DC power supply and control logic are integrated within the elementary radiating cell without increasing the elementary radiating cell size in the radial direction starting from the radiating element center. As previously described with respect to FIG. 7, an exemplary elementary radiating cell has an element size of 0.5 wavelengths by incorporating a compact hybrid combiner. Therefore, in an exemplary embodiment, the radiating cell's reduced size is maintained by integrating the active components and adding additional layers. This implementation is achieved by taking advantage of a multilayer configuration. In an exemplary embodiment and with reference to FIG. 5A, a long via connects the outputs of the hybrid combiner with a lower layer where the other components of the elementary radiating cell are integrated below the radiating element itself. Specifically, in an exemplary embodiment, the phase shifters, MMIC, and the DC components are located under the radiating element, allowing the overall elementary radiating cell to remain in a surface area having a radius smaller than 0.5 wavelengths.

Figure 9:
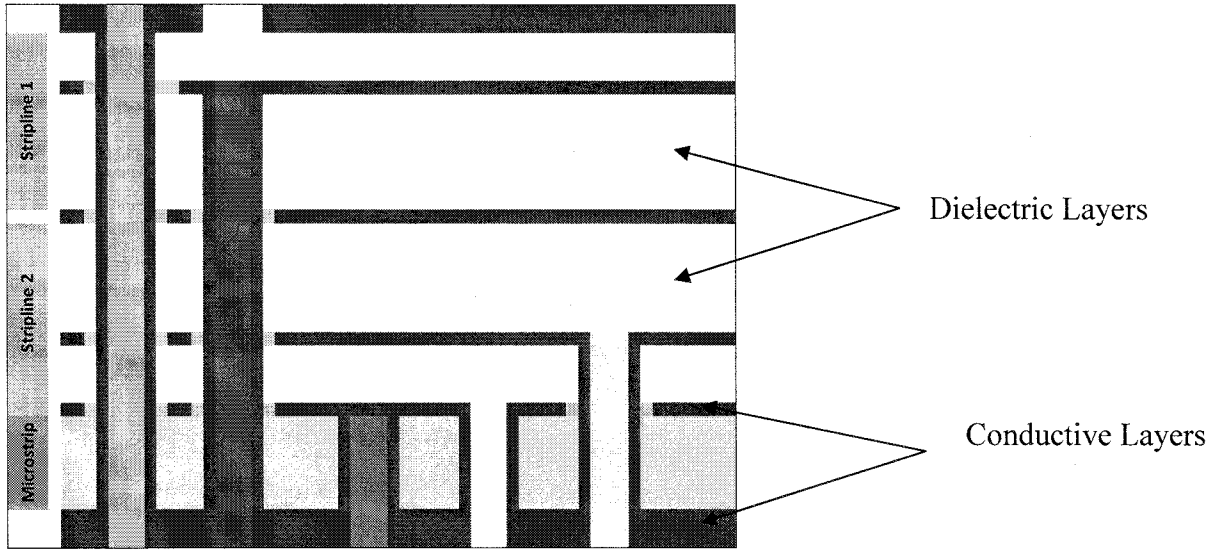
FIG. 9 illustrates an exemplary embodiment of a radiating element structure to be manufactured using a single press process.

In accordance with an exemplary embodiment and with reference to FIG. 9, an elementary radiating cell implements a buildup to be manufactured in a simple and inexpensive manner. In particular, an exemplary radiating cell buildup is designed to be manufactured using a single press process. Accordingly, the single press process is aided by selecting material thickness as well as their disposition to facilitate the manufacturing of the assembly with one single press. The single press process considerably reduces the manufacturing costs.

In one exemplary embodiment, an asymmetrical configuration of stripline layers is implemented. For example, beam forming network layers and feed line circuit layers may have an asymmetrical configuration. This specific selection allows reducing the length of the vias on the bottom part of the radiating cell buildup. In an exemplary embodiment, the reduction of these vias is of primary importance in order to allow them to be implemented as "blind vias". In an exemplary embodiment, blind vias are vias manufactured by drilling the boards to a particular depth, but not all the way through the boards. In an exemplary embodiment, the vias are metalized by depositing copper or similar metal from the open end. Blind vias are limited in that the length is generally less than the diameter of the via. Therefore, their length determines the minimum diameter. In other words, the longer the blind via, the larger the diameter of the via.

In an exemplary embodiment, the diameter of the vias is also related to the RF performance of the vias themselves. For example, a thin via would allow a better RF impedance matching in comparison to a thick via. Therefore, for RF applications it is of primary importance to limit the length of the blind vias in order to be able to implement them with a small diameter. In an exemplary embodiment and with reference to FIG. 9, the radiating cell buildup comprises the radiating element cell layers before the ground plane being thin in order to achieve thinner blind vias. In other words, a thin feed circuit layer can implement thin blind vias, which improves impedance matching. In one exemplary embodiment, this results in a specific asymmetrical design of the stripline beam forming network.

Figure 10:
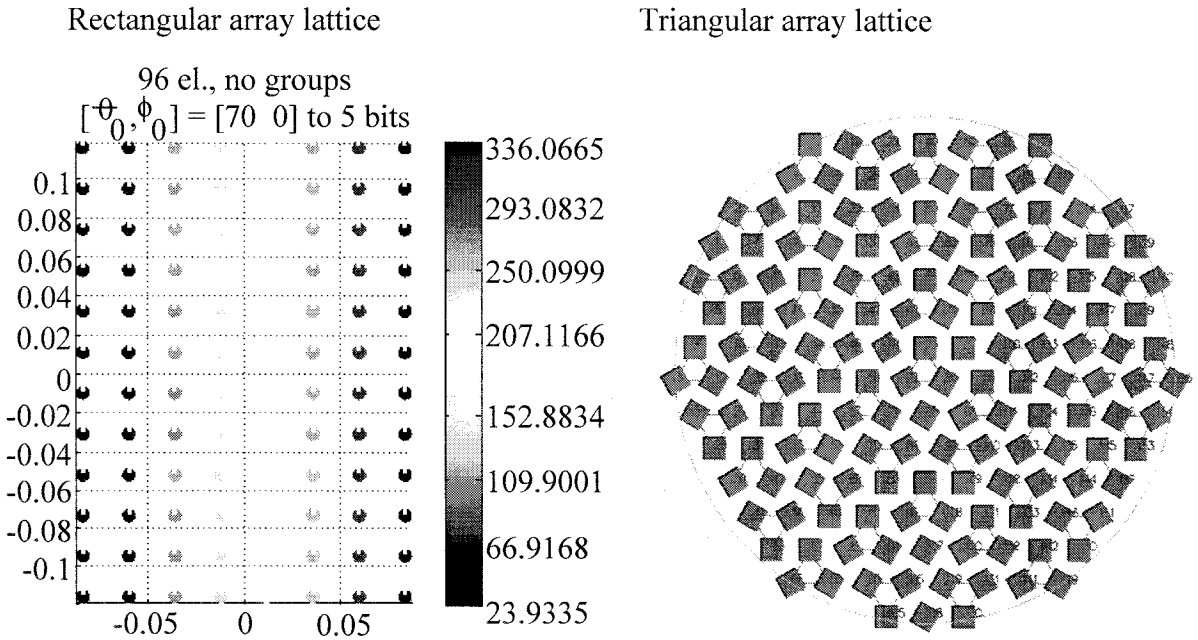
FIG. 10 illustrates a comparison between a rectangular array lattice and a triangular array lattice for radiating elements.

A compact elementary radiating cell is useful if designing a phased array antenna with limited space that is configured for low elevation scanning. It is also beneficial to implement a triangular lattice for improved radiation pattern. FIG. 10 shows an example of a comparison between a rectangular and a triangular array lattice. The triangular lattice ensures the minimum distance between the radiating elements in all azimuth direction. In an exemplary embodiment, a triangular lattice is an optimal array configuration for phased arrays with broad scan capabilities. The possibility to implement a triangular lattice with radiating element spacing lower than 0.6 wavelengths is greatly facilitated by the fact that the elementary radiating cell has a size smaller than 0.5 wavelengths.

The size of the elementary radiating cell is of primary importance for an effective phased array implementation. An oversized large elementary radiating cell would require more spacing and result in the element having a limited scan capability. Moreover, the element rotation may also be determined by the elementary radiating cell size and shape. Additional details can be found in U.S. patent application Ser. No. 12/417,513, entitled "Subarray Polarization Control Using Rotated Dual Polarized Radiating Elements", which was filed on Apr. 2, 2009 and is incorporated herein by reference. A particular element rotation may result in improved polarization characteristics. However, the elementary radiating cell consumes an adequate size and shape to arrange the elements in this particular configuration. FIG. 11A shows an exemplary arrangement where the elementary radiating cell does not fit within the specified element distance and the cells overlap.

Figure 11B:
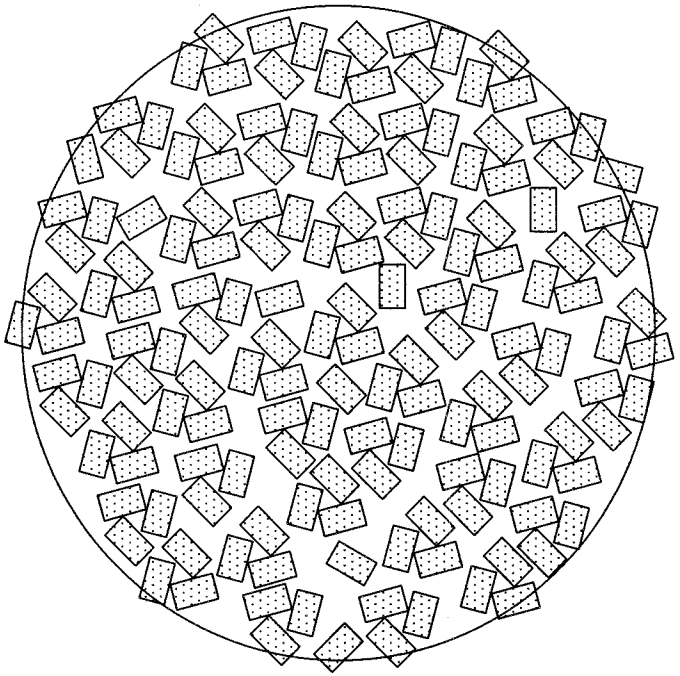
FIGS. 11A and 11B illustrate arrangements of groups of radiating elements in accordance with exemplary embodiments.
Figure 11A:
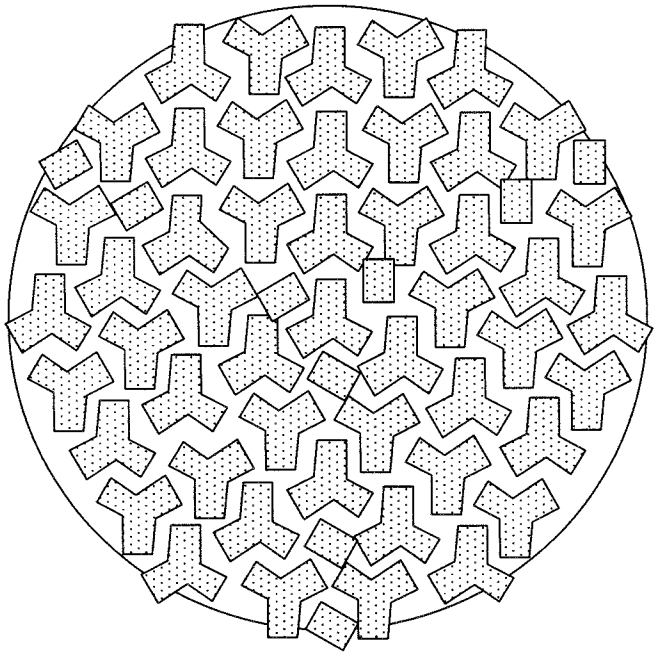

In an exemplary embodiment and with reference to FIG. 11B, the rotation of the elements is designed in order to improve the overall characteristics of the array. This exemplary design relaxes the requirements at the elementary radiating cell level and results in an overall cost reduction of the antenna. In the exemplary embodiment, the elementary radiating cell is sufficiently small to facilitate the rotation and spacing to achieve the particular element rotation that results in this improvement. In accordance with an exemplary embodiment, the size of an elementary radiating cell fits within a single layer array lattice with rotation of the elementary radiating cell. Various design and techniques as previously described facilitate obtaining the desire elementary radiating cell size, such as a compacted hybrid, rotation of the element with respect to the hybrid, and multilayer implementation. The result of this optimized elementary radiating cell and the specific array configuration is a cost optimized phased array. In an exemplary embodiment, the lack of performance at the element level is compensated by the specific architecture at the array level.

The present invention has been described above with reference to various exemplary embodiments. However, those skilled in the art will recognize that changes and modifications may be made to the exemplary embodiments without departing from the scope of the present invention. For example, the various exemplary embodiments can be implemented with other types of power supply circuits in addition to the circuits illustrated above. These alternatives can be suitably selected depending upon the particular application or in consideration of any number of factors associated with the operation of the system. Moreover, these and other changes or modifications are intended to be included within the scope of the present invention, as expressed in the following claims.

What is claimed is:

1. An antenna array comprising a plurality of radiating cells, the radiating cells each comprising:

a patch antenna;

an upper ground plane, the upper ground plane having a first side facing the patch antenna, wherein the upper ground plane comprises at least a first slot and a second slot, wherein the first slot is orthogonal to the second slot;

a lower ground plane; and a stripline feed network, the stripline feed network located on a second side of the upper ground plane and between the upper and lower ground planes, wherein the upper ground plane isolates the patch antenna from the stripline feed network, wherein the stripline feed network further comprises:

a compacted hybrid, wherein the compacted hybrid comprises a first port, a second port, a third port, and a fourth port;

a first stripline starting at the first port and extending under the patch antenna to cross under the first slot at an angle perpendicular to the first slot; and a second stripline starting at the second port and extending under the patch antenna to cross under the second slot at an angle perpendicular to the second slot;

wherein the radiating cells of the antenna array comprise radiating element spacing lower than 0.6 wavelengths.

2. The antenna array of claim 1, wherein the compacted hybrid comprises a first branch, a second branch, a third branch, and a fourth branch, wherein the first branch and the second branch are straight stripline branch segments of the compacted hybrid, parallel to each other, and wherein the third branch and fourth branch are each bent stripline branch segments.

3. The antenna array of claim 2, wherein the first stripline, at a location under the patch antenna, is non-orthogonal to any of the first branch and the second branch.

4. The antenna array of claim 1, wherein a center axis of at least one of the first slot and the second slot of the upper ground plane is at a 45° angle to the first stripline at the first port of the compacted hybrid.

5. The antenna array of claim 1, wherein a center axis of at least one of the first slot and the second slot of the upper ground plane is within an angled range of 20° -70° to the first stripline at the first port of the compacted hybrid.

6. The antenna array of claim 1, further comprising a feed circuit layer in communication with the stripline feed network via vias.

7. The antenna array of claim 6, further comprising blind vias connecting the third port and fourth port of the compacted hybrid with the feed circuit layer.

8. The antenna array of claim 7, wherein the length of the blind vias is smaller than the diameter of the vias.

9. The antenna array of claim 1, wherein the first slot and the second slot each form at least one of an "H"-shaped slot or a "C"-shaped slot.

10. The antenna array of claim 1, further comprising a second patch antenna located on the first side of the upper ground plane and a dielectric layer separating the patch antenna and the second patch antenna.

11. The antenna array of claim 10, wherein the patch antenna is coupled to the second patch antenna.

12. The antenna array of claim 1, wherein a distance from the center of the patch antenna to the farthest port of the third port and the fourth port of the compacted hybrid is ½ wavelengths or less.

13. The antenna array of claim 1, further comprising a feed circuit layer having a first microstrip connected to the third port of the compacted hybrid through a first long via, the feed circuit layer having a second microstrip connected to the fourth port of the compacted hybrid through a second long via, wherein the feed circuit layer facilitates integrating other components of each radiating cell below the radiating cell itself;

wherein the feed circuit layer further comprises one of a phase shifter, a monolithic microwave integrated circuit, and a direct current component, connected to one of the first and second microstrips.

14. The antenna array of claim 1, wherein the third port is connected to a first microstrip in a feed circuit layer, wherein the forth port is connected to a second microstrip in the feed circuit layer, wherein the first microstrip is connected to a first monolithic microwave integrated circuit (MMIC), and wherein the second microstrip is connected to a second MMIC, and wherein the first MMIC and the second MMIC are located under the patch antenna and integrated into each radiating cell.

15. The antenna array of claim 1, wherein the antenna array is a phased array, and wherein the plurality of radiating cells are laid out in a triangular lattice array configuration.

* * * * *